United States Patent [19]

Chatten

[11] 4,020,337

[45] Apr. 26, 1977

[54] ORNAMENTAL BUBBLE LAMP

[76] Inventor: Victor H. Chatten, 1567 W. 215th St., Torrance, Calif. 90501

[22] Filed: Jan. 8, 1976

[21] Appl. No.: 647,556

[52] U.S. Cl. ..... 240/10 A

[51] Int. Cl.[2] ..... A47G 33/16

[58] Field of Search ..... 240/10 A, 10 P, 10 B, 240/10 R

[56] References Cited

UNITED STATES PATENTS

| | | | |
|---|---|---|---|
| 1,293,594 | 2/1919 | Willey | 240/10 R X |
| 2,164,378 | 7/1939 | Berwick | 240/10 R |
| 2,174,446 | 9/1939 | Otis | 240/10 A X |
| 2,378,934 | 6/1945 | Kloner | 240/10 A UX |
| 2,468,283 | 4/1949 | Abramson | 240/10 A X |
| 2,481,358 | 9/1949 | Smith | 240/10 A X |
| 2,617,501 | 11/1952 | Quelle | 240/10 R UX |
| 2,701,929 | 2/1955 | Lemelson | 240/10 A X |
| 3,530,289 | 9/1970 | Friedman et al. | 240/10 R X |
| 3,662,381 | 5/1972 | Steffens | 240/10 R X |

FOREIGN PATENTS OR APPLICATIONS

| | | | |
|---|---|---|---|
| 2,242,303 | 3/1973 | Germany | 240/10 R |

*Primary Examiner*—Donald A. Griffin
*Attorney, Agent, or Firm*—Lyon & Lyon

[57] ABSTRACT

An ornamental lamp employs one or more upward extending transparent tubes containing an electrically non-conductive liquid under a partial vacuum. A heater at the lower end of each tube causes bubbles to form and to pass through a restriction and to ascend in the liquid. A series of electric lamps are spaced at intervals within the tube above the restriction. The lamps supply additional heat as the bubbles ascend to prevent condensation of the bubbles. The lamps also illuminate the bubbles. A pleasing twinkling effect is produced as each bubble passes one of the lamps.

20 Claims, 14 Drawing Figures

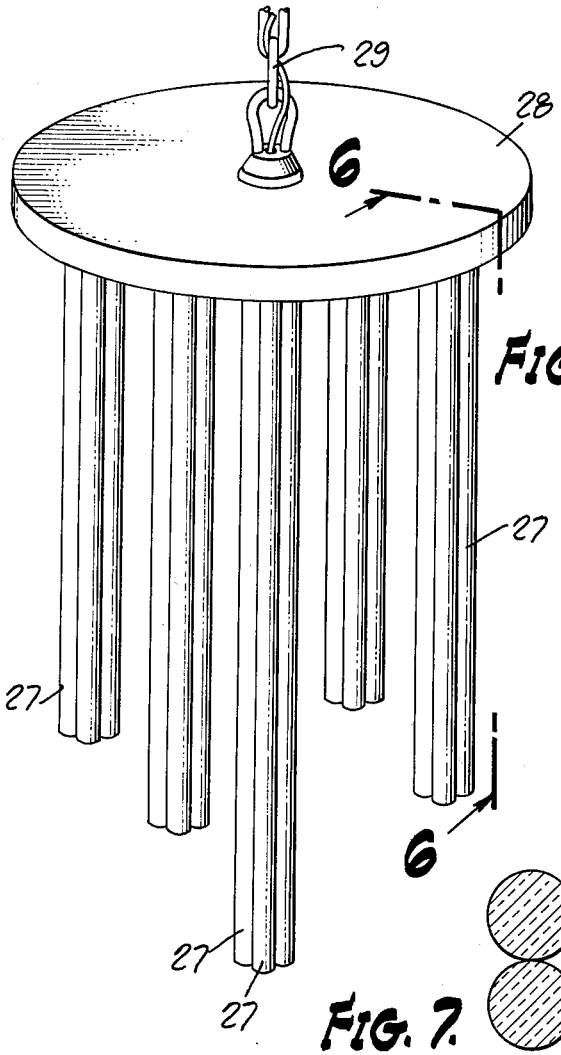
FIG. 5.
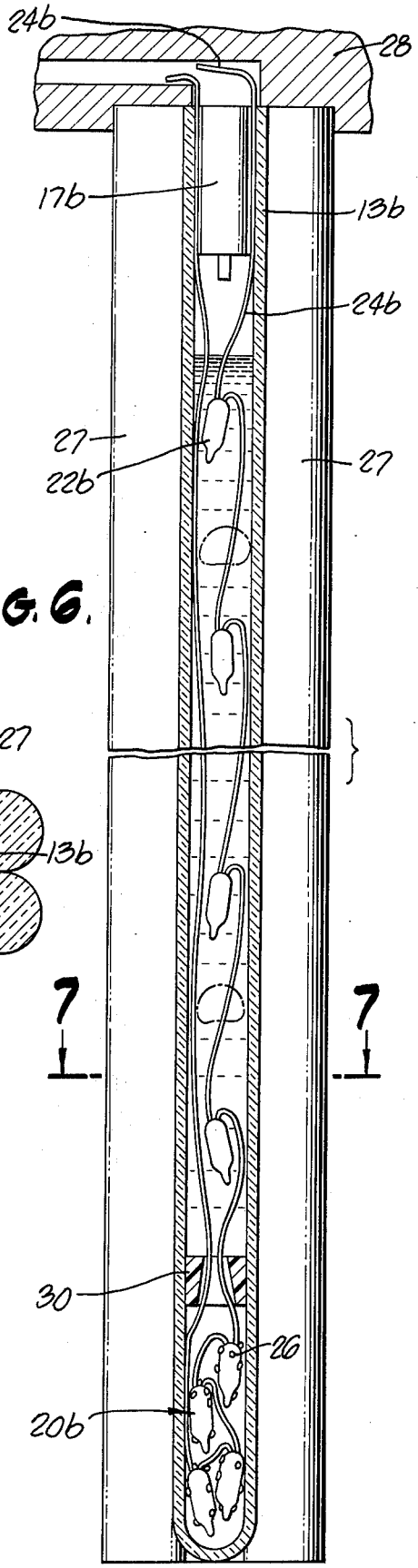
FIG. 6.
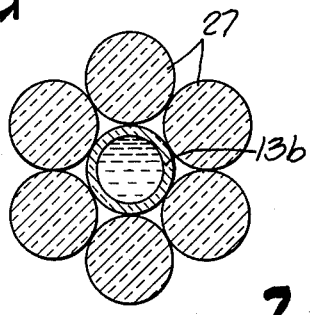
FIG. 7.
FIG. 9.
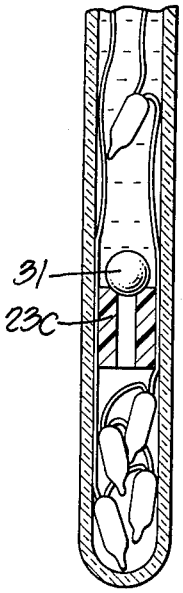
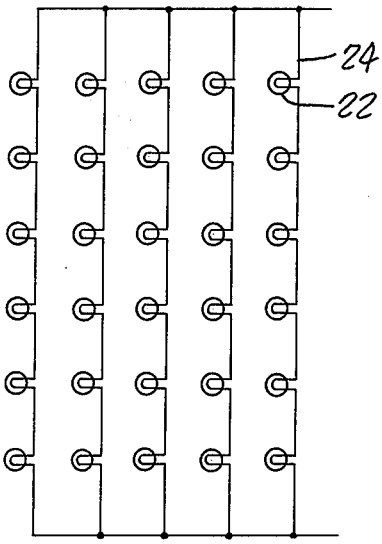
FIG. 8.

ORNAMENTAL BUBBLE LAMP

This invention relates to ornamental lamps and is particularly directed to a unique form of lamp employing bubbles which rise in a tube filled with liquid. The bubbles are formed near the lower end of each tube and pass a series of small electric lamps positioned in the tube and spaced at intervals along the length of the tube. The lamps provide additional heat so that the bubbles do not disappear by condensation as they ascend through the liquid. The lamps also illuminate the bubbles as they move upward, and a very pleasing visual effect is produced by the illuminated bubbles rising in the colored or colorless liquid, and enhanced by the twinkling effect caused by the bubbles as they pass each of the electric lamps.

Bubble lamps are known in the prior art, but the bubble tube was necessarily short because only an external heater lamp at the base provided any heat, and as a result the bubbles would disappear by condensation after traveling for a short distance through the liquid. This invention is distinquished by the presence of a series of spaced electric lamps which twinkle because of the change of intensity of light emitted through the liquid and bubble tube each time a bubble passes one of the lamps. The length of the bubble tubes is not limited to a few centimeters but, on the other hand, the bubble tubes may extend for several meters, or any desired length, because the series of spaced electric lamps supply additional heat to maintain the vapor state of the bubbles and to prevent them from condensing and dying out as they ascend through the liquid.

At least a portion of the length of each bubble tube is transparent. The tubes are preferably colorless and the liquid is preferably colored. The bubble tubes in any one lamp assembly may all contain liquid of the same color, or individual tubes may have different colors of liquid, depending on the ornamental appearance desired. The liquid is very low in electrical conductivity to avoid short-circuiting the wiring within the tubes connecting the individual lamps.

Various types of heating devices may be employed, and various means may be used for initially establishing the intensity of the vacuum within each bubble tube.

Other and more detailed objects and advantages will appear hereinafter.

In the drawings:

FIG. 5 is a perspective view showing a further modified form of the invention.

FIG. 6 is a sectional elevation taken substantially on the lines 6—6 as shown on FIG. 5.

FIG. 7 is a transverse sectional view taken substantially on the lines 7—7 as shown on FIG. 6.

FIG. 8 is a wiring diagram of the device of FIGS. 5, 6 and 7.

FIG. 9 is a fragmentary sectional view showing a modification.

Figure 1:
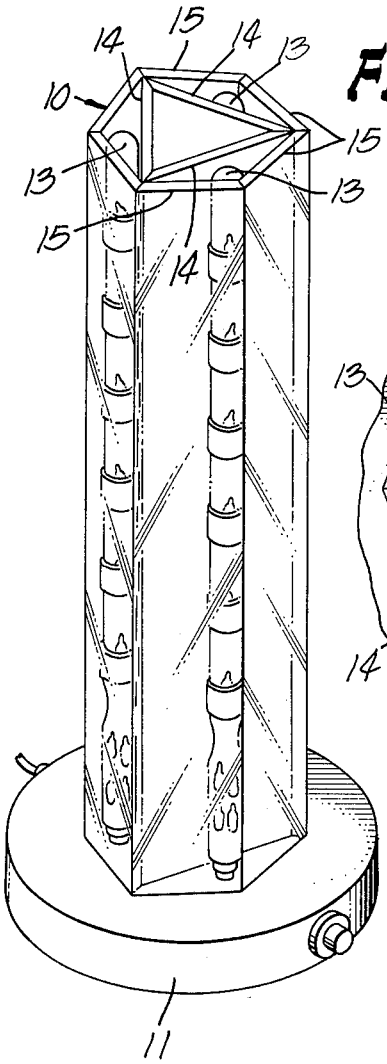
FIG. 1 is a perspective view showing a preferred embodiment of this invention.
Figure 2:
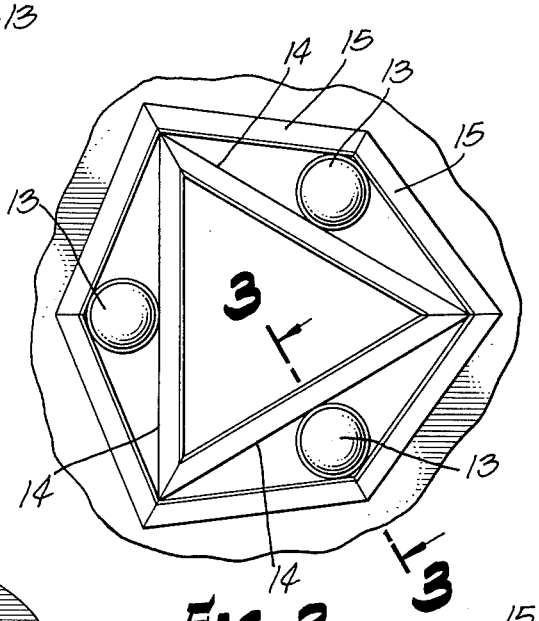
FIG. 2 is a top plan view partly broken away and shown on a larger scale.
Figure 3:
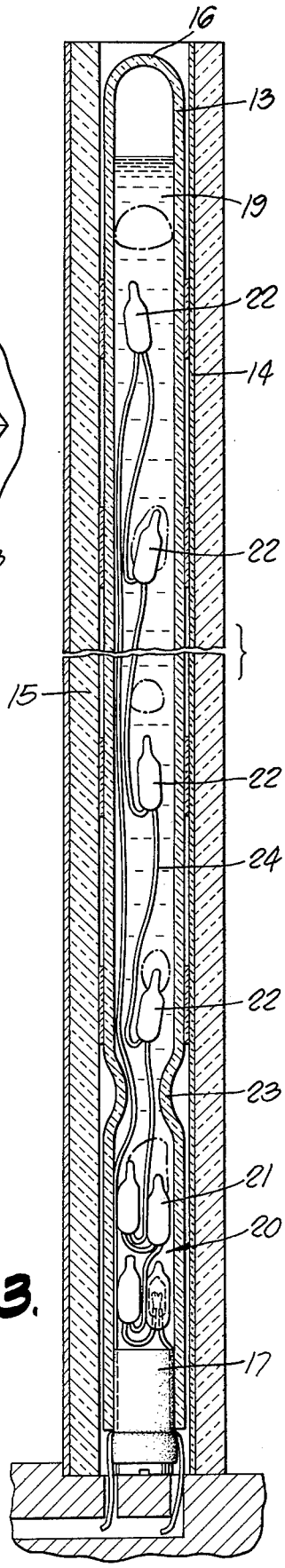
FIG. 3 is a sectional elevation taken substantially on the lines 3—3 as shown in FIG. 2.

Referring to FIGS. 1–3 of the drawings, the ornamental lamp generally designated 10 comprises a base 11 having a plurality of upright bubble tubes 13 supported thereon. A plane mirror 14 is mounted adjacent each of the bubble tubes 13. Two transparent mirrors 15 of the half-silvered type cooperate with each mirror 14 to enclose one of the upright bubble tubes 13. The visual effect caused by reflection between mirrors produces an infinite number of images.

Each bubble tube 13 has a closed upper end 16 and is provided with a closure device 17 at its lower end. Each tube has a vapor space 25 at its upper end. Each bubble tube is hermetically sealed after the air has been displaced by the liquid. Each bubble tube is formed of transparent material and each contains a colored liquid 19 having very low electrical conductivity. A cluster 20 of small incandescent lamps 21 is mounted within a bubble tube near its lower end to serve as a heater to cause bubbles to form in the tube 13 and ascend through the column of liquid 19. Additional electric lamps 22 are positioned within the bubble tube 13 and are spaced at intervals along the length of the tube above the heating cluster 20. These small electric lamps 22 have several functions: They supply additional heat along the length of the bubble tube 13 to maintain the vapor state of the bubbles and thereby prevent condensation of bubbles ascending throught the column of liquid 19. They also illuminate the bubbles themselves. Furthermore, the intensity of light emitted through the tube 13 from each electric lamp 22 in the series increases momentarily when a bubble passes that particular electric lamp, to cause a twinkling effect. Translucent color sleeves 18 may encircle each bubble tube 13 at longitudinal intervals. The electric lamps 21 and 22 are connected in series by means of wiring 24 positioned within the tube 13.

An effect very pleasing to the eye is produced by the illuminated bubbles rising in the colored liquid and by the twinkling action when each bubble passes an individual electric lamp 22. A restriction 23 is placed between the heater lamp cluster 20 and the spaced lamps 22, and the purpose of this restriction is to promote the production of large bubbles, well spaced, instead of a large number of smaller bubbles.

Figure 4:
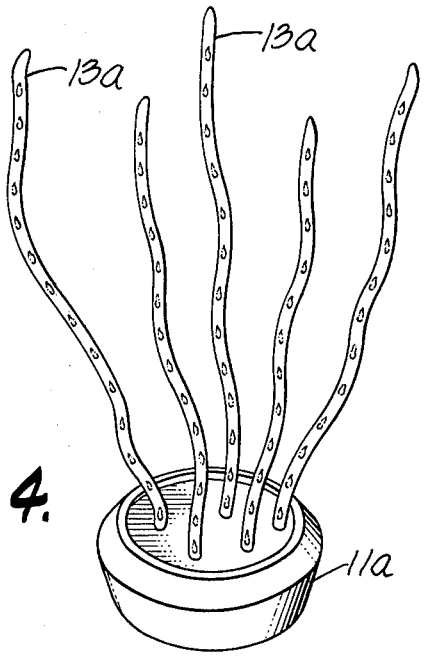
FIG. 4 is a perspective view showing a modified form of the invention.

In the modified form of the invention shown in FIG. 4, the individual bubble tubes **13*a* are free standing and are curved rather than straight. They are supported on a base 11*a*, and as a group they tend to simulate a growing plant. Artifical foliage (not shown) may be added to the free standing bubble tubes 13*a* for ornamental effect, if desired. The construction and operation of the bubble tubes 13*a*** are the same as that previously described.

In the modified form of the invention shown in FIGS. 5–8, the bubble tubes **13*b* are straight and each is surrounded by six transparent bars 27. Each of the bubble tubes 13*b* and transparent bars 27 are supported by and extend downward from a pendant member 28 suspended by a chain 29. The wiring 24***b* for the spaced electric lamps 22*b* and the cluster 20*b* extends through the closure device 17*b* near the upper end of the bubble tube 13*b*. The wiring diagram for the five bubble tubes is shown in FIG. 8. Either direct or alternating current many be supplied. A restrictor ring 30 is placed within each bubble tube 13*b* just above the heating cluster 20*b*. Sharp glass or quartz granules 26 are cemented to the outer surface of the heater lamps 20*b* to enhance the formation of bubbles. The operation of this form of the invention is similar to that described above. In addition, the transparent bars 27 arranged around each bubble tube 13*b* enhance the twinkling effect and produce multiple images.

Figure 10:
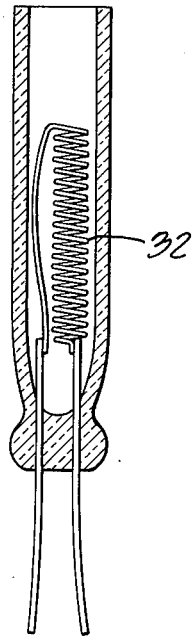
FIG. 10 is a sectional elevation of a coil heater assembly.
Figure 11:
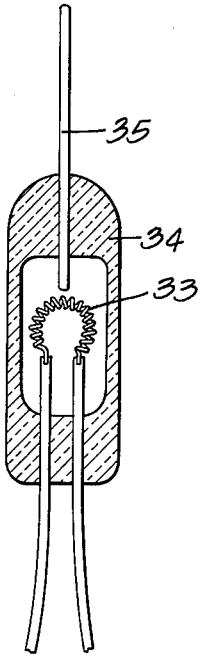
FIG. 11 is a sectional view of another form of coil heater assembly.
Figure 12:
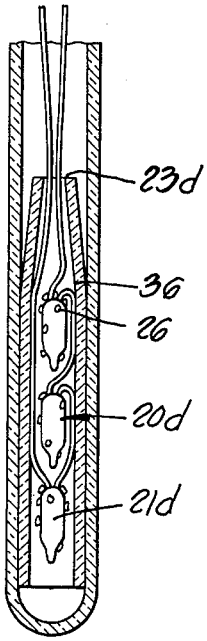
FIG. 12 is a sectional view showing another form of heater assembly comprising a cluster of lamps, and a restriction.
Figure 13:
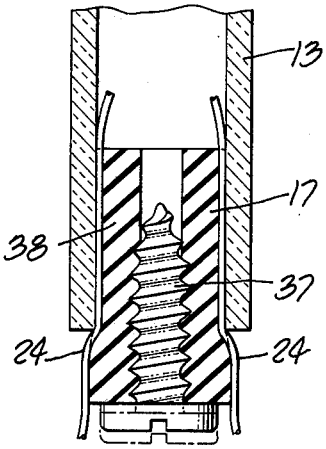
FIG. 13 is a sectional elevation of a device for initially establishing the intensity of vacuum within a bubble tube.
Figure 14:
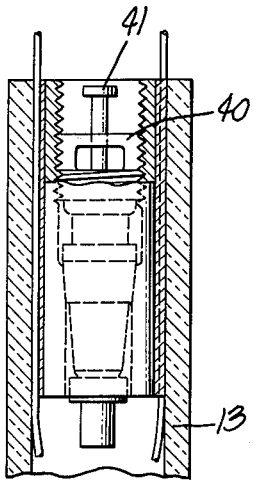
FIG. 14 is a view similar to FIG. 13 showing another form of vacuum control device.

FIGS. 9–14 show details of construction of modified forms of portions of the apparatus. In FIG. 9, a ball valve 31 cooperates with a restrictor sleeve 23*c* to increase the size of the bubbles which move upward through the liquid in the tube. FIGS. 10, 11 and 12 show different forms of heaters, and FIGS. 13 and 14 show different forms of apparatus for controlling the intensity of the vacuum or pressure within each bubble tube.

The electrical resistance coil 32 shown in FIG. 10 may be used to supply heat for initially forming bubbles in the liquid near the lower end of the tube. The heater coil 33 shown in FIG. 11 serves the same purpose, but the coil 33 does not directly contact the liquid in the tube. Instead, the heat is carried from the capsule 34 into the liquid by means of the heat conducting rod 35. The cluster 20*d* of electric lamps 21*d* as shown in FIG. 12 are carried within an insert sleeve 36 having a restricted opening 23*d*.

The bubble tubes are sealed at both ends in order to prevent loss of liquid by the boiling action of the bubbles. It is desirable to reduce the pressure within the bubble tubes as compared to atmospheric pressure in order to lower the boiling point. The proper vacuum intensity may be achieved by filling the tube with liquid before insertion of the closure device 17, as shown in FIG. 13. The tube 13 is then positioned so that the closure device 17 is at its lower end. The tapered screw plug 37 is then turned with respect to the resilient sealing sleeve 38 to allow escape of some of the liquid from the tube 13. All this is done at room temperature. When the liquid level at the upper end of the tube has falled to a predetermined level, the tapered screw plug 37 is tightened to prevent any further escape of liquid or vapor.

The modified form of vacuum adjuster shown in FIG. 14 includes a "Schrader" poppet valve assembly 40 which is of the type ordinarily used in automobile tires or inner tubes, but provided with a resilient valve seat not subject to attack by the liquid within the tube. The plunger 41 may be depressed manually to open the valve to permit escape of liquid from the bubble tube 13.

Although the vacuum adjuster of FIG. 13 is shown on the lower end of the bubble tube and the vacuum adjuster of FIG. 14 is shown on the upper end, either of these devices may be employed at either end of the bubble tube.

I claim:

1. In an ornamental device, the combination of: an upward extending tube containing a liquid and having a vapor space at its upper end, at least a portion of the tube being transparent, means for heating the liquid in a lower portion of the tube to cause bubbles to form and to ascend in the liquid, and additional heating means within and at spaced intervals along the length of the tube to preserve the vapor state of the ascending bubbles and prevent their condensation.

2. In an ornamental device, the combination of: an upward extending tube containing a liquid and having a vapor space at its upper end, at least a portion of the tube being transparent, means for heating the liquid in a lower portion of the tube to cause bubbles to form and to ascend in the liquid, and electric lamps positioned at spaced intervals within the tube to illuminate the bubbles and to supply additional heat to preserve the vapor state of the ascending bubbles and prevent their condensation.

3. In an ornamental device, the combination of: an upward extending tube containing a liquid and having a vapor space at its upper end, at least a portion of the tube being transparent, a cluster of electric lamps within a portion of the tube to heat the liquid and cause bubbles to form and to ascend in the liquid, and additional electric lamps in the tube at spaced intervals along the length of the tube to preserve the vapor state of the ascending bubbles and prevent their condensation.

4. In an ornamental device, the combination of: an upward extending transparent tube closed at both ends and having a vapor state at its upper end, and containing a colored liquid, means for heating the liquid in a lower portion of the tube to cause bubbles to form and ascend in the liquid, and at least one electric lamp in the tube spaced above said heating means to supply additional heat and thereby prevent condensation of the ascending bubbles, whereby the intensity of light emitted through the tube from said electric lamp increases momentarily when a bubble passes said electric lamp.

5. In an ornamental device, the combination of: an upward extending transparent tube closed at both ends and having a vapor spaced at its upper end, and containing a liquid of low electrical conductivity, means for heating the liquid in a lower portion of the tube to cause bubbles to form and ascend in the liquid, and a series of electric lamps in the tube above said heating means and spaced at intervals along the length of the tube to supply additional heat and thereby prevent condensation of the ascending bubbles, whereby the intensity of light emitted through the tube from each electric lamp in the series increases momentarily when a bubble passes the electric lamp.

6. In an ornamental device, the combination of: an upward extending transparent tube closed at both ends and having a vapor space at its upper end, and containing a colored liquid, a cluster of electric lamps within a lower portion of the tube to heat the liquid and to cause bubbles to form and ascend in the liquid, and a series of electric lamps in the tube above said cluster and spaced at intervals along the length of the tube to illuminate the bubbles and to supply additional heat to prevent condensation of the ascending bubbles.

7. In an ornamental device, the combination of: an upward extending tube containing a liquid and having a vapor space at its upper end, at least a portion of the tube being transparent, heating means within a portion of the tube to heat the liquid and cause bubbles to form and to ascend in the liquid, said heating means including sharp granules projecting from the heating means to enhance the formation of bubbles, and additional electric lamps in the tube at spaced intervals along the length of the tube to preserve the vapor state of the ascending bubbles and prevent their condensation.

8. In an ornamental lamp, a base, a plurality of upward extending transparent tubes mounted on the base, each tube being closed at both ends and having a vapor space at its upper end, each tube containing a liquid, heating means adjacent a lower portion of each tube to heat the liquid and to cause bubbles to form and ascend in the liquid, a series of electric lamps in each tube above said heating means and spaced at intervals along the length of the tube to supply additional heat and thereby prevent condensation of the ascending bubbles, and mirrors on said base adjacent each tube to reflect the upward travel of bubbles illuminated by said electric lamps.

9. In an ornamental lamp, a base, a plurality of upward extending non-parallel transparent tubes mounted on and projecting upward from the base, each tube being closed at both ends and having a vapor space at its upper end, each tube containing a liquid, heating means adjacent a lower portion of each tube to heat the liquid and to cause bubbles to form and ascend in the liquid, and a series of electric lamps in each tube above said heating means and spaced at intervals along the length of the tube to supply additional heat and thereby prevent condensation of the ascending bubbles.

10. In an ornamental lamp, a pendant support member, a plurality of transparent tubes depending from the support member, each tube being closed at both ends and having a vapor space at its upper end, each tube containing a liquid, heating means adjacent a lower portion of each tube to heat the liquid and to cause bubbles to form and ascend in the liquid, and a series of electric lamps in each tube above said heating means and spaced at intervals along the length of the tube to supply additional heat and thereby prevent condensation of the ascending bubbles.

11. In an ornamental device, an upward extending straight transparent tube closed at both ends and having a vapor space at its upper end, each tube containing a liquid, heating means adjacent a lower portion of the tube to heat the liquid and to cause bubbles to form and ascend in the liquid, a series of electric lamps in the tube above said heating means and spaced at intervals along the length of the tube to supply additional heat and thereby prevent condensation of the ascending bubbles, and solid transparent straight bars encircling the tube to enhance the display of upward travel of bubbles illuminated by said electric lamps.

12. In an ornamental device, the combination of: an upward extending tube closed at both ends and having a vapor space at its upper end, each tube containing a liquid, heating means within a lower portion of the tube to heat the liquid and to cause bubbles to form and ascend in the liquid, at least one electric lamp in the tube spaced above said heating means to supply additional heat and thereby prevent condensation of the ascending bubbles, and a restriction within the tube between said heating means and said electric lamp.

13. The device of claim 12 in which the heating means comprises a cluster of electric lamps.

14. The device of claim 12 in which a ball valve is provided to regulate passage of bubbles through the restriction.

15. In an ornamental device, an upward extending tube closed at both ends and containing a liquid, at least a portion of the tube being transparent, heating means adjacent a lower portion of the tube to heat the liquid and to cause bubbles to form and ascend in the liquid, at least one electric lamp in the tube spaced above said heating means to supply additional heat and thereby prevent condensation of the ascending bubbles, and means for varying the pressure within the tube.

16. The device of claim 15 in which the latter said means comprises a resilient annular insert in the tube together with expansion plug means within the annular insert.

17. The device of claim 15 in which the latter said means includes a valve within the tube.

18. In an ornamental device, an upward extending tube closed at both ends and containing a liquid, at least a portion of the tube being transparent, heating means adjacent a lower portion of the tube to heat the liquid and to cause bubbles to form and ascend in the liquid, at least one electric lamp in the tube spaced above said heating means to supply additional heat and thereby prevent condensation of the ascending bubbles, said heating means comprising an electrical resistance coil within the tube.

19. The device of claim 18 in which said electrical resistance coil is positioned within a closed capsule within the tube, and a heating rod extending from the interior of the capsule into the liquid in the tube.

20. In an ornamental device having an upwardly extending tube containing a liquid and having a vapor space at its upper end and heating means in the tube adjacent the bottom thereof, the improvement comprising:

said heater means being electrical resistance element, an envelope member enclosing said element and a multiplicity of sharp granules on the outer surface of said envelope member.

* * * * *

UNITED STATES PATENT AND TRADEMARK OFFICE

CERTIFICATE OF CORRECTION

PATENT NO. : 4,020,337

DATED : April 26, 1977

INVENTOR(S) : Victor H. Chatten

It is certified that error appears in the above-identified patent and that said Letters Patent are hereby corrected as shown below:

Column 2, line 37, "throught" should read --through--.

Column 3, line 47, "falled" should read --fallen--.

Claim 4, line 27, "state" should read --space--.

Claim 20, line 48, "an" should be inserted after "heater means being".

Signed and Sealed this

*fifth* Day of *July 1977*

[SEAL]

*Attest:*

RUTH C. MASON
*Attesting Officer*

C. MARSHALL DANN
*Commissioner of Patents and Trademarks*